United States Patent [19]

Pugliese

[11] Patent Number: 4,776,634

[45] Date of Patent: Oct. 11, 1988

[54] ARMCHAIR STRUCTURE HAVING INDEPENDENTLY ADJUSTABLE BACK, SEAT AND FOOT-REST

[76] Inventor: Francesco Pugliese, Via L. Spagna, 50-96100 Siracusa, Italy

[21] Appl. No.: 52,785

[22] Filed: May 21, 1987

[30] Foreign Application Priority Data

May 29, 1986 [IT] Italy ..... 48080 A/86

[51] Int. Cl.[4] ..... A47C 1/02

[52] U.S. Cl. ..... 297/328; 297/28; 297/359

[58] Field of Search ..... 297/28, 27, 359, 26, 297/25, 433, 367

[56] References Cited

U.S. PATENT DOCUMENTS

| | | | |
|---|---|---|---|
| 433,836 | 8/1890 | Van Slyke | 297/359 |
| 2,410,088 | 10/1946 | Lundquist | 297/433 |
| 2,659,416 | 11/1953 | Heyman | 297/28 |
| 2,972,373 | 2/1961 | Thomas | 297/28 |
| 3,709,554 | 1/1973 | Feher | 297/28 X |

FOREIGN PATENT DOCUMENTS

| | | | |
|---|---|---|---|
| 2234877 | 1/1975 | France | 297/359 |
| 496755 | 4/1930 | Fed. Rep. of Germany | 297/28 |

*Primary Examiner*—Peter A. Aschenbrenner
*Attorney, Agent, or Firm*—Ladas & Parry

[57] ABSTRACT

Armchair structure with independently adjustable back, seat and foot-rest, wherein the back is hinged at one end of the seat frame, and the foot-rest is hinged at the opposite end, the frame itself being hinged at the support structure beyond the center line of its length and towards its end facing the back. Each longitudinal element of the seat frame is provided, at the fulcrum of the back, with a toothing as a rack against which acts the extremity of an angle lever hinged at the support structure in the proximity of the armrest, the actuation of the free end of said lever allowing the disengagement of the lever itself from the rack and the engagement thereof with said rack in the new position taken on by the seat, the angle levers being interconnected in correspondence of the ends that engage with the racks. The foot-rest, at the point where it is hinged at the front end of the seat frame, is provided with a toothing rotatable therewith, against which resiliently acts a ratchet, that can be released by means of a suitable push-button.

2 Claims, 1 Drawing Sheet

ARMCHAIR STRUCTURE HAVING INDEPENDENTLY ADJUSTABLE BACK, SEAT AND FOOT-REST

The invention relates to an armchair and more particularly, an armchair having an adjustable back, seat and footrest.

It is known that, for complete relaxation of the stresses of modern life, people must find the resting positions best suited to their respective bodies. For this, various adjustable armchairs are known.

For example, there is the common deck chair. Its adjustability consists only in adjustment for a more or less outstretched position of a body. There are also known small armchairs in which the angle of the back can be set from an almost upright position to a more or less inclined position relative to the seat, which, however, remains in its original horizontal position. In other known armchairs, the orientation of the back depends upon the position of a foot rest. In consequence, a sitter is sometimes obliged to take undersidered or uncomfortable positions.

It is, therefore, an objection of the invention to provide an armchair structure having an independently-adjustable back, seat and footrest.

Another object of the invention is an armchair wherein the seat can be set in different positions according to the sitter's will without actually getting up.

These and other objects and advantages of the invention will be clearer from the following detailed description of a preferred embodiment thereof, with reference to the attached drawings wherein.

Figure 1:
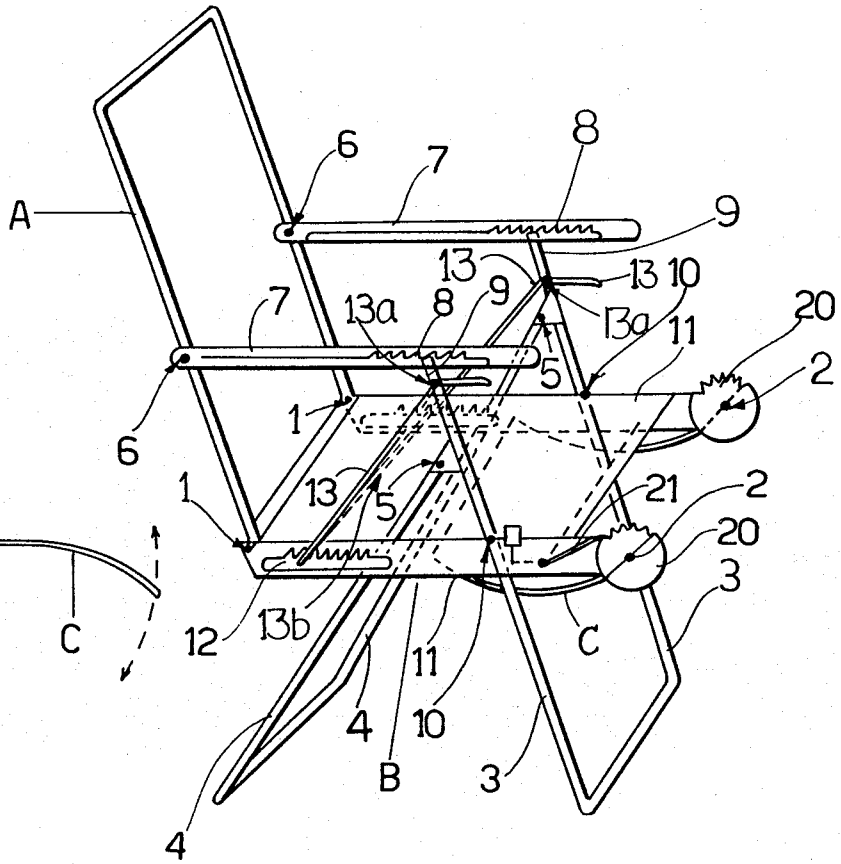
FIG. 1 is a side/front perspective view of the preferred embodiment.

With reference to the drawings, a preferred armchair structure according to the present invention generally consists of three parts: a back A; a seat B; and a footrest C. One, lower end of the back A is hinged at 1 to one, rear end of the seat B, and the footrest C is hinged at 2 to the opposite, front end of the seat B.

Front leg elements 3 and rear leg elements 4 hold up the three above-mentioned parts A, B, C. For this, opposite sides of the seat B are hinged at 10 to the front leg element 3. The front and rear leg elements are U-shaped and hinged to each other at opposite sides at 5 so as to form an inverted-V stand in side elevation (FIG. 2), but they could be independent from each other, other elements then being used to give the necessary rigidity.

The back A is a frame as is the seat B. Opposite-side uprights of the back A are hinged at 6 to ends of respective armrests 7. Opposite, free ends of the armrests 7 have, in a known manner, respective racks 8 engaging respective extensions 9 of the leg elements 3 extending upwardly, beyond the hinges at 5. By disengaging the extensions 9 from the racks 8 and displacing the armrests 7 axially of the racks, it is possible to adjust inclination of the back A relative to the seat B by pivoting it about the hinges at 1 therebetween.

The frame of seat B has opposite-side longitudinal members 11, the rear ends of which are at the hinges at 1 to the back, and the hinges at 10 to the front leg elements 3 are frontward of center therealong, in close proximity to the opposite, front end to which the footrest C is secured. Each longitudinal member 11 of the seat has a downward-facing rack 12 between the hinges at 1 and 10. The racks 12 respectively engage one end of the one arm of double-armed levers 13. The opposite ends of the one arms are respectively hinged at **13*a* to the front leg elements 3 in proximity to the extension 9 thereof and the other, free-ended arm of each lever 13 projects therefrom substantially parallel to the armrest 7. By slightly moving a body on the seat frontwards, towards the hinges 10 and the footrest C, and acting at the same time on the free-ended arms of each lever 13, therefore, it is possible to disengage the levers 13 from one notch of the racks 12 and engage another notch, thereby either to raise or to lower the rear end of the seat B at the back A by rotation about the hinges at 10. Preferably, the levers 13 resiliently engage the racks 12**, so as to secure any position taken by the seat B.

The one ends of the one arms of the levers 13 engaging the racks 12 are preferably interconnected, as at **13*b*, so that the one arms perform identical movements to the same positions on the respective racks 12**. This avoids any twisting of the seat. The inclination of the back A and seat B can be adjusted independently, therefore, as can the footrest C.

Figure 2:
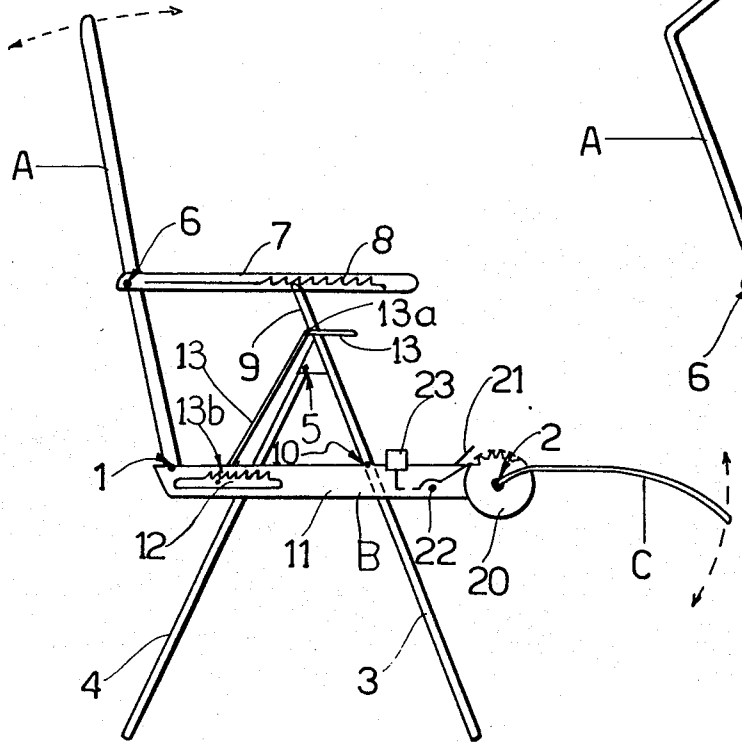
FIG. 2 is a side elevation of the preferred embodiment with a footrest in a different, outstretched position.

The footrest C is hinged at 2 at the opposite, front end of the seat B from the back A, as already explained, and has toothed portions 20 rotatable therewith thereat. A suitable spring (not shown) urges the toothed positions 20 to rotate about the hinges at 10 so as to bring the footrest either into alignment with the seat, as shown in FIG. 1, as in this embodiment, or to be raised with respect thereto, as shown in FIG. 2. Ratchet palls 21 (only one shown) are resiliently urged respectively against the toothed portions 20 to set the footrest C in any desired position. Schematically-shown push-buttons 23 (only one shown) respectively pivot the ratchet palls 21 on hinges 22 (only one shown) to disengage ratchet palls 21 and, by then acting with one's legs, the footrest C can be either lowered or let raise to the desired position.

In another embodiment (not shown), the footrest obviously could be formed by a plurality of interlinked consecutive sections for setting either to the working or to the resting positions (FIGS. 1 or 2, respectively) with suitable resilient constraints and return springs, instead of the above-mentioned ratchet and toothing.

It can be noted from the above that the invention fully answers its objects. That is, an armchair with independently-adjustable back, seat and footrest is obtained, it not being necessary for the sitter to get up for this.

The armchair structure with independently adjustable back, seat and footrest of the present invention may vary in its shape, finish, sizes and in every detail, provided its substantial claimed characteristics are not changed or modified.

I claim:

1. An armchair, comprising:

two front and rear leg elements hingedly connected to each other, the front leg elements having upward extensions;

a seat comprising longitudinal members on opposite sides and hinges respectively connecting the longitudinal members to the front leg elements;

a back hingedly connected to one, rear end of the seat;

arms respectively connected hingedly at one end to the back and respectively having racks for respectively engaging the upward extensions of the front leg elements;

downwardly-facing racks on the longitudinal members of the seat between the hinges and the one, rear end of the seat; and two double-armed levers, each lever having one arm having one end engaged with a respective one of the downwardly-facing racks and an opposite end hingedly connected to a respective one of the front leg elements in proximity to the extension thereof and a second, free-ended arm projecting therefrom, whereby appropriately pivoting the seat on the hinges connecting it to the front leg elements disengages the one ends of the one arms of the double-armed levers from the downwardly-facing recks and pivoting the double-armed levers about their hinged connection to the front leg elements with the second, free-ended arms thereof adjusts the inclination of the seat when pivoted for the downwardly-facing racks thereof to re-engage the one ends of the one arms of the double-armed levers.

2. The armchair of claim 1 wherein the one ends of the one arms of the double-armed levers are interconnected.

* * * * *